US008949001B2

(12) United States Patent
Suzuki

(10) Patent No.: US 8,949,001 B2
(45) Date of Patent: Feb. 3, 2015

(54) CONTROL APPARATUS AND CONTROL METHOD FOR INTERNAL COMBUSTION ENGINE

(71) Applicant: Takashi Suzuki, Gotenba (JP)

(72) Inventor: Takashi Suzuki, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 113 days.

(21) Appl. No.: 13/788,302

(22) Filed: Mar. 7, 2013

(65) Prior Publication Data

US 2013/0261936 A1 Oct. 3, 2013

(30) Foreign Application Priority Data

Mar. 28, 2012 (JP) ..... 2012-074713

(51) Int. Cl.

| | |
|---|---|
| ***F02D 41/30*** | (2006.01) |
| ***F02D 41/00*** | (2006.01) |
| ***F02D 41/14*** | (2006.01) |
| *F02D 41/06* | (2006.01) |
| *F02D 41/22* | (2006.01) |

(52) U.S. Cl.

CPC ..... *F02D 41/3005* (2013.01); *F02D 41/008* (2013.01); *F02D 41/1498* (2013.01); *F02D 41/064* (2013.01); *F02D 2041/228* (2013.01)

USPC ..... 701/104; 701/114; 123/691

(58) Field of Classification Search

USPC ..... 701/102–104, 108, 110, 112, 114; 123/179.1–179.4, 672, 685, 687, 123/690–692; 73/114.22, 114.23, 114.25, 73/114.72

See application file for complete search history.

(56) References Cited

U.S. PATENT DOCUMENTS

| | | | | |
|---|---|---|---|---|
| 5,904,129 | A * | 5/1999 | Kadota | 123/406.45 |
| 5,915,368 | A * | 6/1999 | Ishida et al. | 123/675 |
| 2005/0183706 | A1 | 8/2005 | Ueda et al. | |
| 2008/0035132 | A1 * | 2/2008 | Katoh et al. | 123/673 |
| 2009/0030592 | A1 * | 1/2009 | Mitsutani | 701/109 |
| 2010/0318279 | A1 * | 12/2010 | Meyer et al. | 701/103 |
| 2012/0197471 | A1 * | 8/2012 | Irisawa | 701/22 |
| 2012/0330533 | A1 | 12/2012 | Noda | |

FOREIGN PATENT DOCUMENTS

| | | | |
|---|---|---|---|
| JP | 11-303664 | A | 11/1999 |
| JP | 2004-225559 | A | 8/2004 |
| JP | 2005-016397 | A | 1/2005 |
| JP | 2010-112244 | A | 5/2010 |
| JP | 2010-270651 | A | 12/2010 |
| JP | 2013-007277 | A | 1/2013 |
| JP | 2013-011204 | A | 1/2013 |

* cited by examiner

*Primary Examiner* — John Kwon
*Assistant Examiner* — Johnny H Hoang
(74) *Attorney, Agent, or Firm* — Gifford, Krass, Sprinkle, Anderson & Citkowski, P.C.

(57) ABSTRACT

A control apparatus for an internal combustion engine is configured to execute an air-fuel ratio control based on an output of an air-fuel ratio detector provided in an exhaust passage through which exhaust gas from a plurality of cylinders flows. The control apparatus includes an abnormal lean deviation detection portion configured to detect whether an abnormal lean deviation is occurring in at least one specific cylinder among the plurality of cylinders, the exhaust gas from the at least one specific cylinder influencing the air-fuel ratio detector more strongly than the exhaust gas from each of a rest of the plurality of cylinders; and an enriching control portion configured to execute an enriching control for the at least one specific cylinder when the abnormal lean deviation detection portion detects that the abnormal lean deviation is occurring in the at least one specific cylinder.

6 Claims, 8 Drawing Sheets

CONTROL APPARATUS AND CONTROL METHOD FOR INTERNAL COMBUSTION ENGINE

INCORPORATION BY REFERENCE

The disclosure of Japanese Patent Application No. 2012-074713 filed on Mar. 28, 2012 including the specification, drawings and abstract is incorporated herein by reference in its entirety.

BACKGROUND OF THE INVENTION

1. Field of the Invention

The invention relates to a control apparatus and a control method for an internal combustion engine configured to execute air-fuel ratio control.

2. Description of Related Art

Generally, in an internal combustion including an exhaust gas control system that uses a catalyst, in order to highly efficiently remove pollutants from exhaust gas using the catalyst, it is necessary to control the mixing rate between air and fuel in a mixture that is burned in the internal combustion engine, that is, to control the air-fuel ratio. In order to execute the control of the air-fuel ratio, an air-fuel ratio sensor is provided in an exhaust passage of the internal combustion engine, and a feedback control is executed so that the air-fuel ratio detected by the sensor becomes equal to a predetermined target air-fuel ratio.

Generally in a multi-cylinder internal combustion engine, the air-fuel ratio feedback control is executed by using the same control amount for all the cylinders. Therefore, despite execution of the air-fuel feedback ratio control, the actual air-fuel ratio sometimes varies among the cylinders. In such a case, if the degree of variation in the air-fuel ratio is a small degree, the variation in the air-fuel ratio can be absorbed by the air-fuel ratio feedback control, and pollutants in exhaust gas can be removed by the catalysts. Thus, small degrees of the variation in the air-fuel ratio do not affect the exhaust emissions, and therefore do not cause any particular problem.

However, if the air-fuel ratio greatly varies among the cylinders due to, for example, failure of the fuel injection system of at least one cylinder or the valve actuation mechanism for the intake valves, etc., the exhaust emission quality deteriorates, thereby causing problems. Various methods and apparatus that detect such a large variation in the air-fuel ratio as to deteriorate exhaust emissions have been proposed.

For example, in an internal combustion engine disclosed in Japanese Patent Application Publication No. 2010-112244 (JP 2010-112244 A), it is firstly determined whether the air-fuel ratios of the cylinders of the internal combustion engine are in an imbalanced state on the basis of a computed value regarding the air-fuel ratio feedback control. In this internal combustion engine, a main air-fuel ratio feedback control is executed on the basis of a result of detection by an A/F sensor provided upstream of an exhaust gas purification catalyst in an exhaust passage, and a subsidiary air-fuel ratio feedback control is executed on the basis of a result of detection by an $O_2$ sensor provided downstream of the exhaust gas purification catalyst. When the average value of computed values in the subsidiary air-fuel ratio feedback control exceeds a usual value, it is determined that the air-fuel ratios of the cylinders are in the imbalanced state. Furthermore, in the internal combustion engine of JP 2010-112244 A, when it is thus determined that there is an air-fuel ratio abnormality among the cylinders, a process of shortening the fuel injection duration for each cylinder by a predetermined amount of time is executed, and a cylinder in which a misfire is caused by the process is specifically determined to be a cylinder that causes an air-fuel ratio imbalance.

In the technologies of the Japanese Patent Application Publication No. 2010-112244 (JP 2010-112244 A) and the like, it is possible to detect inter-cylinder air-fuel ratio imbalance in so-called multi-cylinder internal combustion engines that have a plurality of cylinders, and particularly, it is possible to detect that an abnormal lean deviation is occurring in an abnormal cylinder, that is, the air-fuel ratio is deviated to the lean side in an abnormal cylinder. If an ordinary air-fuel ratio feedback control is simply executed when such an abnormal lean deviation is occurring, the amount of fuel injection for all the cylinders becomes large. Therefore, for example, in the case where the degree of abnormal lean deviation is great and an exhaust gas purification catalyst provided in the exhaust passage is a so-called three-way catalyst, the exhaust air-fuel ratio of a normal cylinder may depart to the rich side from a high-efficiency process region for the exhaust gas purification catalyst, and consequently, the catalytic conversion rate of the hydrocarbon component may decline. The possibility of the occurrence of such a problem increases particularly in the case where an abnormal lean deviation occurs in a cylinder that discharges the exhaust gas that strongly influences the air-fuel ratio sensor provided in the exhaust passage of the internal combustion engine.

SUMMARY OF THE INVENTION

The invention suppresses a decrease in the purification rate (conversion rate) of an exhaust gas purification catalyst when an abnormal lean deviation is occurring in at least one cylinder among a plurality of cylinders, the exhaust gas from the at least one cylinder influencing an air-fuel ratio sensor more strongly than the exhaust gas from each of the rest of the plurality of cylinders.

A first aspect of the invention relates to a control apparatus for an internal combustion engine. The control apparatus is configured to execute an air-fuel ratio control based on an output of an air-fuel ratio detector provided in an exhaust passage through which exhaust gas from a plurality of cylinders flows. The control apparatus includes an abnormal lean deviation detection portion configured to detect whether an abnormal lean deviation is occurring in at least one specific cylinder among the plurality of cylinders, the exhaust gas from the at least one specific cylinder influencing the air-fuel ratio detector more strongly than the exhaust gas from each of a rest of the plurality of cylinders; and an enriching control portion configured to execute an enriching control for the at least one specific cylinder when the abnormal lean deviation detection portion detects that the abnormal lean deviation is occurring in the at least one specific cylinder.

The enriching control portion may execute the enriching control for the at least one specific cylinder so that an amount of fuel injection for the at least one specific cylinder is larger than that at a time when the abnormal lean deviation detection portion detects that no abnormal lean deviation is occurring in the at least one specific cylinder. The enriching control portion may execute the enriching control for the at least one specific cylinder so that the amount of fuel injection for the at least one specific cylinder is larger than that at the time when the abnormal lean deviation detection portion detects that no abnormal lean deviation is occurring in the at least one specific cylinder, by an amount based on a degree of the abnormal lean deviation detected by the abnormal lean deviation detection portion.

When the enriching control portion executes the enriching control for the at least one specific cylinder, the enriching control portion may execute an averaging control for the plurality of cylinders excluding the at least one specific cylinder so that a total amount of fuel injection for all the plurality of cylinders is not changed by the enriching control.

The at least one specific cylinder may be one cylinder, the exhaust gas from the one cylinder influencing the air-fuel ratio detector more strongly than the exhaust gas from each of the rest of the plurality of cylinders.

The abnormal lean deviation detection portion may detect whether the abnormal lean deviation is occurring in the at least one specific cylinder, based on change in engine revolution speed at a time of cold engine start or a value that represents the change in the engine revolution speed at the time of cold engine start.

The control apparatus according to the above-described aspect may further include an imbalance absence detection portion configured to detect whether inter-cylinder air-fuel ratio imbalance is absent after the abnormal lean deviation detection portion detects that the abnormal lean deviation is occurring in the at least one specific cylinder; and an ending portion configured to end an operation of the enriching control portion when the imbalance absence detection portion detects that the inter-cylinder air-fuel ratio imbalance is absent.

A second aspect of the invention relates to a control method for an internal combustion engine. In the control method, an air-fuel ratio control is executed based on an output of an air-fuel ratio detector provided in an exhaust passage through which exhaust gas from a plurality of cylinders flows. The control method includes detecting whether an abnormal lean deviation is occurring in at least one specific cylinder among the plurality of cylinders, the exhaust gas from the at least one specific cylinder influencing the air-fuel ratio detector more strongly than the exhaust gas from each of a rest of the plurality of cylinders; and executing an enriching control for the at least one specific cylinder when it is detected that the abnormal lean deviation is occurring in the at least one specific cylinder.

According to the foregoing aspects of the invention, in the above-described configurations, when an abnormal lean deviation is occurring in at least one specific cylinder among a plurality of cylinders, the exhaust gas from the at least one specific cylinder influencing the air-fuel ratio detector more strongly than the exhaust gas from each of the rest of the plurality of cylinders, the enriching control is executed for the at least one specific cylinder. Thus, it is possible to achieve a particular effect of suppressing a decrease in the purification rate (conversion rate) of an exhaust gas purification catalyst.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of the invention will be described hereinafter with reference to the accompanying drawings.

Figure 1:
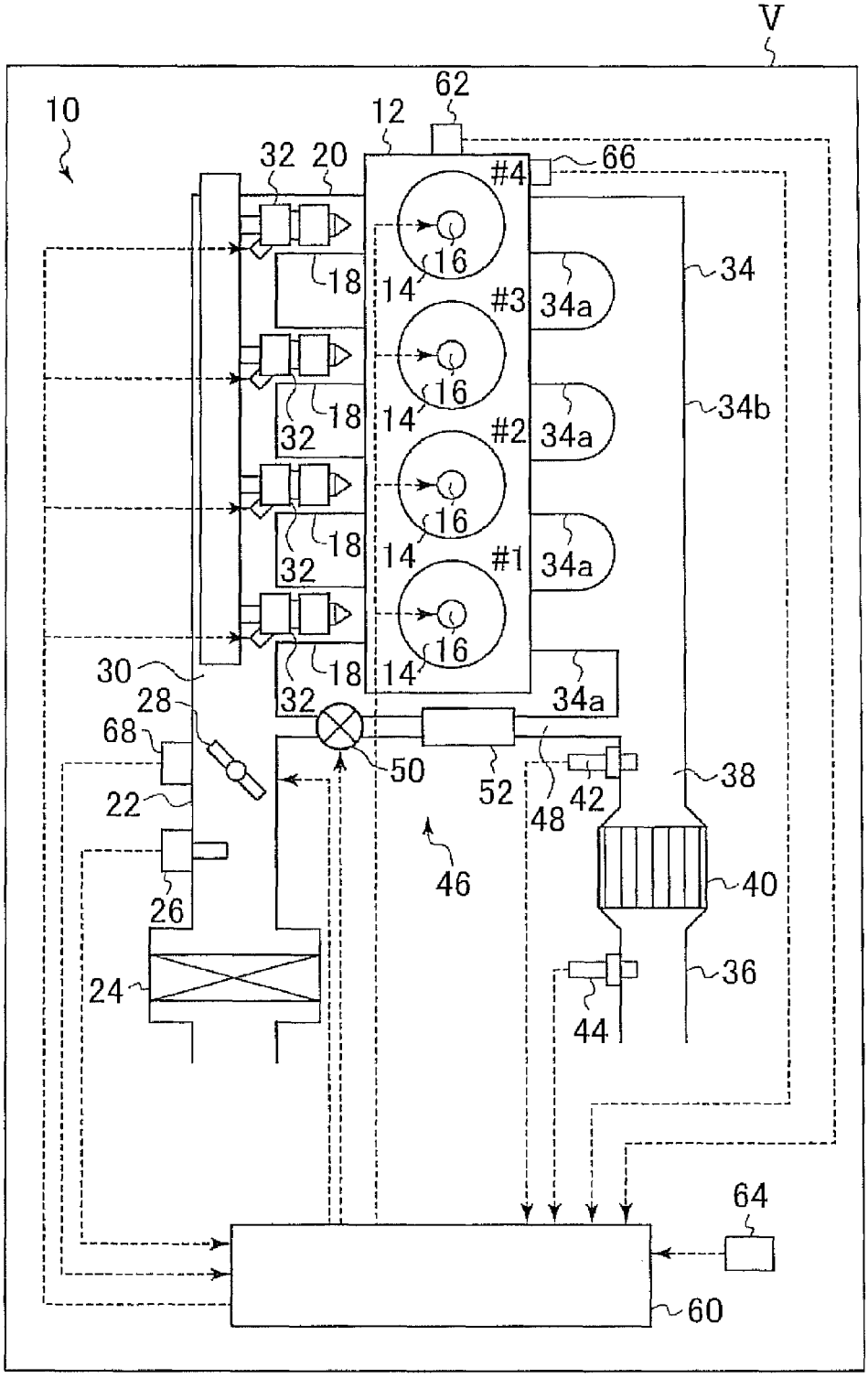
FIG. 1 is a schematic diagram showing an internal combustion engine to which a first embodiment of the invention is applied, and a vehicle in which the internal combustion engine is mounted.

FIG. 1 is a schematic diagram of an internal combustion engine (engine) 10 to which a first embodiment of the invention is applied. As shown in FIG. 1, the engine 10 produces power when a mixture of fuel and air is burned in combustion chambers 14 that are formed in the engine 10 including a cylinder block 12, and therefore a piston is reciprocated in each of cylinders of the cylinder block 12. This engine 10 is a four-stroke-per-cycle engine. The engine 10 is a multi-cylinder internal combustion engine for a vehicle (an automobile) and, more concretely, an in-line four-cylinder spark ignition internal combustion engine (i.e., gasoline engine). The engine 10 is mounted in a vehicle V. However, the internal combustion engines to which the invention is applicable are not limited to the aforementioned kind of engine, and may be any multi-cylinder internal combustion engine, irrespective of the number of cylinders, the type, etc., as long as the internal combustion engine has two or more cylinders.

Although not shown in the drawings, in a cylinder head of the engine 10, intake valves that open and close intake ports and exhaust valves that open and close exhaust ports are disposed for the respective cylinders. The intake valves and the exhaust valves are opened and closed by camshaft(s). In a top portion of the cylinder head, ignition plugs 16 for igniting the air-fuel mixture or fuel in the combustion chambers 14 are provided for the respective cylinders.

The intake ports of the cylinders are connected to an intake manifold 20 that includes branch pipes 18 that correspond to the individual cylinders. An intake pipe 22 is connected to an upstream side of the intake manifold 20. An air cleaner 24 is provided on an upstream end of the intake pipe 22. An air flow meter 26 for detecting the amount of intake air and an electronically controlled throttle valve 28 are incorporated in the intake pipe 22 in that order from the upstream side. The intake ports, the intake manifold 20 and the intake pipe 22 each define and form a portion of an intake passage 30.

Fuel injection valves (injectors) 32 that inject fuel into the intake passage, particularly into the intake ports, are provided for the respective cylinders. The fuel injected from each injector 32 is mixed with intake air to form a mixture that is taken into a corresponding one of the combustion chambers 14 when the intake valve is opened. Then, the mixture is compressed by the piston, and is ignited to burn by the ignition plug 16. The cylinder firing order is an order of #1, #3, #4 and #2 cylinders.

On the other hand, the exhaust ports of the cylinders are connected to an exhaust manifold 34. The exhaust manifold 34 includes branch pipes 34*a* that are provided separately for the respective cylinders and that constitute an upstream portion of the exhaust manifold 34, and an exhaust collection portion 34*b* that constitutes a downstream portion of the exhaust manifold 34. An exhaust pipe 36 is connected to a downstream side of the exhaust collective portion 34*b*. The exhaust ports, the exhaust manifold 34 and the exhaust pipe 36 each define and form a portion of an exhaust passage 38. The exhaust pipe 36 is provided with a catalytic converter 40 that contains a three-way catalyst. The catalytic converter 40 constitutes an exhaust gas control apparatus. The catalytic converter 40 functions so as to simultaneously purify (remove, convert) NOx, HC and CO, which are pollutants in exhaust gas, when the air-fuel ratio of the inflowing exhaust gas (exhaust air-fuel ratio) A/F is in the vicinity of a stoichiometric air-fuel ratio (e.g., A/F=14.6).

First and second air-fuel ratio sensors, that is, a pre-catalyst sensor 42 and a post-catalyst sensor 44 are disposed upstream and downstream of the catalytic converter 40, respectively. Each of the first and second air-fuel ratio sensors (i.e., each of pre-catalyst sensor 42 and the post-catalyst sensor 44) detects the exhaust air-fuel ratio. The pre-catalyst sensor 42 and the post-catalyst sensor 44 are disposed in the exhaust passage through which exhaust gas from the #1 to #4 cylinders flows, at positions immediately upstream and downstream of the catalytic converter 40. The pre-catalyst sensor 42 and the post-catalyst sensor 44 output signals based on the oxygen concentration in exhaust gas. The post-catalyst sensor 44 may be omitted. In this construction, both the pre-catalyst sensor 42 and the post-catalyst sensor 44 are air-fuel ratio detectors. However, in the case where the post-catalyst sensor 44 is omitted, only the pre-catalyst sensor 42 is provided as an air-fuel ration detector.

In the engine 10 shown in FIG. 1, the exhaust system is configured so that the exhaust gas from the #1 cylinder contacts the pre-catalyst sensor 42 more strongly than the exhaust gas from each of the #2 to #4 cylinders. Also, the exhaust system is configured so that the exhaust gas from the #1 cylinder contacts the post-catalyst sensor 44 more strongly than the exhaust gas from each of the #2 to #4 cylinders. In this specification, the #1 cylinder, which discharges the exhaust gas that contacts the pre-catalyst sensor 42 more strongly than the exhaust gas from each of the other cylinders, may be referred to as "a specific cylinder" in order to distinguish the #1 cylinder from the other cylinders. Similarly, the intake system is configured so that when air simply flows through the intake passage 30, the largest portion of the air that flows through the intake passage 30 flows into the #1 cylinder among all the cylinders.

Furthermore, there is provided an exhaust gas recirculation system (EGR system) 46 for supplying a portion of the exhaust gas that flows in the exhaust passage 38, into the intake passage 30. The EGR system 46 includes an EGR passage 48 that connects the exhaust passage 38 and the intake passage 30, an EGR valve 50 provided on the EGR passage 48 and an EGR cooler 52 for cooling EGR gas. Although not indicated in FIG. 1, the EGR passage 48 is configured so that the largest portion of EGR gas flows into the #1 cylinder among all the cylinders. As a result, when the EGR valve 50 is open, similar amounts of air, that is, fresh air are introduced to the #1 to #4 cylinders during their intake strokes.

The aforementioned ignition plugs 16, the throttle valve 28, the injectors 32, the EGR valve 50, etc., are electrically connected to an electronic control unit (ECU) 60. The ECU 60 is configured so as to substantially perform various functions as various control portions (i.e., as a control apparatus) and various detection portions of the engine 10. The ECU 60 includes a processing unit (e.g., CPU), a storage device that includes a ROM and a RAM, input/output ports, etc. (none of which is shown). The ECU 60, as shown in FIG. 1, is also electrically connected to the air flow meter 26, the pre-catalyst sensor 42 and the post-catalyst sensor 44 and, furthermore, to a crank angle sensor 62 for detecting the crank angle of the engine 10, an accelerator operation amount sensor 64 for detecting the amount of accelerator operation, a coolant temperature sensor 66 for detecting the engine coolant temperature, a throttle opening degree sensor 68 for detecting the degree of throttle opening, and other various sensors, via A/D converters and the like (not shown). On the basis of outputs (output signals) and/or detection values provided by the various sensors (detectors), etc., the ECU 60 controls the ignition plugs 16, the throttle valve 28, the injectors 32, the EGR valve 50, etc., so as to control the ignition timing, the degree of throttle opening, the amount of fuel injection, the fuel injection timing, the degree of EGR opening, etc., so that a desired engine output is obtained.

Thus, the ECU 60 substantially performs the functions as a fuel injection control portion, an ignition control portion, an intake air flow rate control portion, etc. Then, the ECU 60 substantially performs a function as an air-fuel ratio control portion that executes an air-fuel ratio control on the basis of the output of the pre-catalyst sensor 42. Furthermore, the ECU 60 substantially performs a function as an abnormal lean deviation detection portion that detects whether an abnormal lean deviation is occurring in the #1 cylinder, which is the specific cylinder. Furthermore, the ECU 60 substantially performs a function as an enriching control portion that executes an enriching control for the specific cylinder. In the embodiment, the abnormal lean deviation detection portion includes an output fluctuation amount detection portion that detects a value that represents the amount of fluctuation of the output (amount of output fluctuation) of the specific cylinder of the engine 1, and a determination portion that determines whether an abnormal lean deviation is occurring in the specific cylinder on the basis of the amount of output fluctuation detected by the output fluctuation amount detection portion.

A throttle opening degree sensor 68 is provided for the throttle valve 28. An output signal of the throttle opening degree sensor 68 is sent to the ECU 60. The ECU 60 usually executes a feedback control for controlling the degree of opening of the throttle valve 28 (throttle opening degree) to a degree of opening that is determined according to the accelerator operation amount.

Furthermore, the ECU 60 detects the amount of intake air per unit time, that is, the intake air flow rate, on the basis of the output signal, of the air flow meter 26. Then, on the basis of at least one of the detected accelerator operation amount, the detected degree of throttle opening and the detected intake air flow rate, the ECU 60 detects the load of the engine 10.

The ECU 60 detects the crank angle, and also detects the number of revolutions of the engine 10, on the basis of a crank pulse signal from the crank angle sensor 62. Herein, the term "number of revolutions" signifies the number of revolutions per unit time, and has the same meaning as the term "the revolution speed (rotation speed)". In this embodiment, "the number of revolutions" signifies the number of revolutions per minute (rpm). On the basis of the output of the crank angle sensor 62, a value that represents fluctuation of revolution (i.e., amount of fluctuation of revolution) is detected.

Usually, the ECU 60 sets the amount of fuel injection (or fuel injection duration) by using data or the like stored beforehand in the storage device, on the basis of the engine load and the engine revolution speed, in other words, the operation state of the engine. Then, on the basis of the amount of fuel injection, the injection of fuel from the injectors 32 is controlled. The fuel injection control will be further described later.

The ECU 60 is configured so as to execute an idling revolution speed control (fast idling revolution speed control) when the engine 10 is started. Concretely, when the engine 10 is started, the idling revolution speed control is executed so as to increase the engine revolution speed according to the engine coolant temperature, thereby improving the drivability of the vehicle. In the idling revolution speed control, the degree of opening of the throttle valve 28 is increased, and then, as the coolant temperature rises, the throttle valve is gradually closed to decrease the engine revolution speed. In a configuration where an ISCV (idle speed control valve) is provided in parallel with the throttle valve, the flow rate of air flowing through the intake passage may be adjusted through the ISCV so as to control the idling revolution speed.

Furthermore, the ECU 60 performs an ignition timing retardation in order to heat the catalyst of the catalytic converter 40 (to warm up the catalyst) at the time of start of the engine, particularly, at the time of cold start of the engine. Due to the ignition timing retardation, the afterburning of fuel occurs, and thus the warm-up of the catalyst is accelerated.

Figure 2:
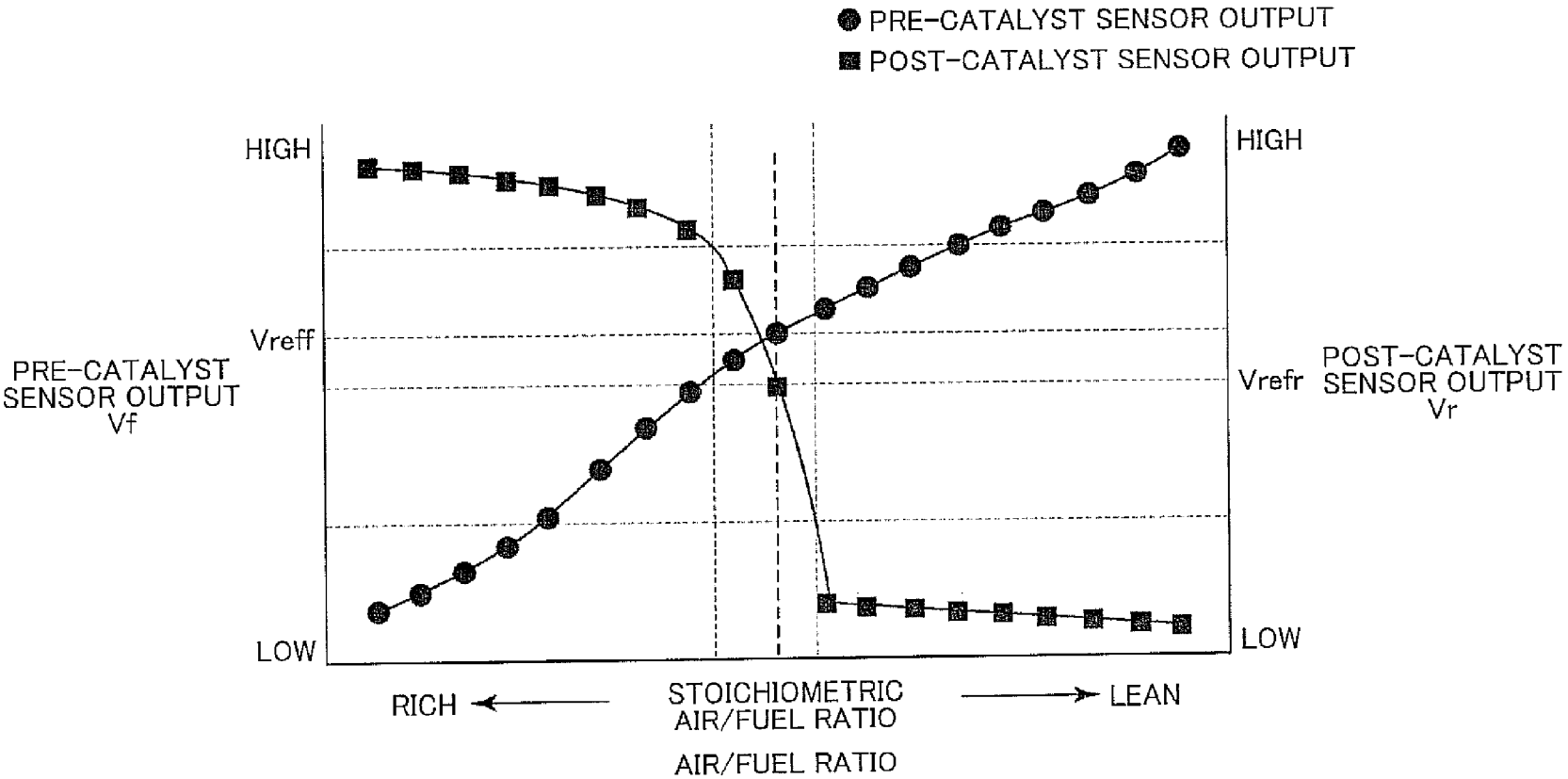
FIG. 2 is a graph as an example that shows the output characteristics of a pre-catalyst sensor and a post-catalyst sensor in the internal combustion engine shown in FIG. 1.

The pre-catalyst sensor 42, which is an air-fuel ratio sensor, is constituted by a so-called wide-range air-fuel ratio sensor, and is capable of continuously detecting the air-fuel ratio over a relatively wide range. FIG. 2 shows the output characteristic of the pre-catalyst sensor 42. As shown in FIG. 2, the pre-catalyst sensor 42 outputs a voltage signal Vf that is proportional in magnitude to the exhaust air-fuel ratio detected by the sensor 42 (pre-catalyst exhaust air-fuel ratio A/Ff). The output voltage at a time when the exhaust air-fuel ratio is stoichiometric is Vreff (e.g., about 3.3 V).

On the other hand, the post-catalyst sensor 44, which is also an air-fuel ratio sensor, is constituted by a so-called $O_2$ sensor, and has a characteristic in which the output value of the sensor changes sharply in the vicinity of the stoichiometric ratio. FIG. 2 shows the output characteristic of the post-catalyst sensor 44. The output voltage at a time when the exhaust air-fuel ratio (post-catalyst exhaust air-fuel ratio A/Fr) is stoichiometric, that is, a stoichiometric ratio-corresponding voltage value, is Vrefr (e.g., 0.45 V). The output voltage of the post-catalyst sensor 44 changes within a predetermined range (e.g., of 0 to 1 V). Generally, when the exhaust air-fuel ratio is leaner than the stoichiometric ratio, the output voltage Vr of the post-catalyst sensor 44 is lower than the stoichiometric ratio-corresponding voltage value Vrefr, and when the exhaust air-fuel ratio is richer than the stoichiometric ratio, the output voltage Vr of the post-catalyst sensor 44 is higher than the stoichiometric ratio-corresponding value Vrefr.

Figure 3:
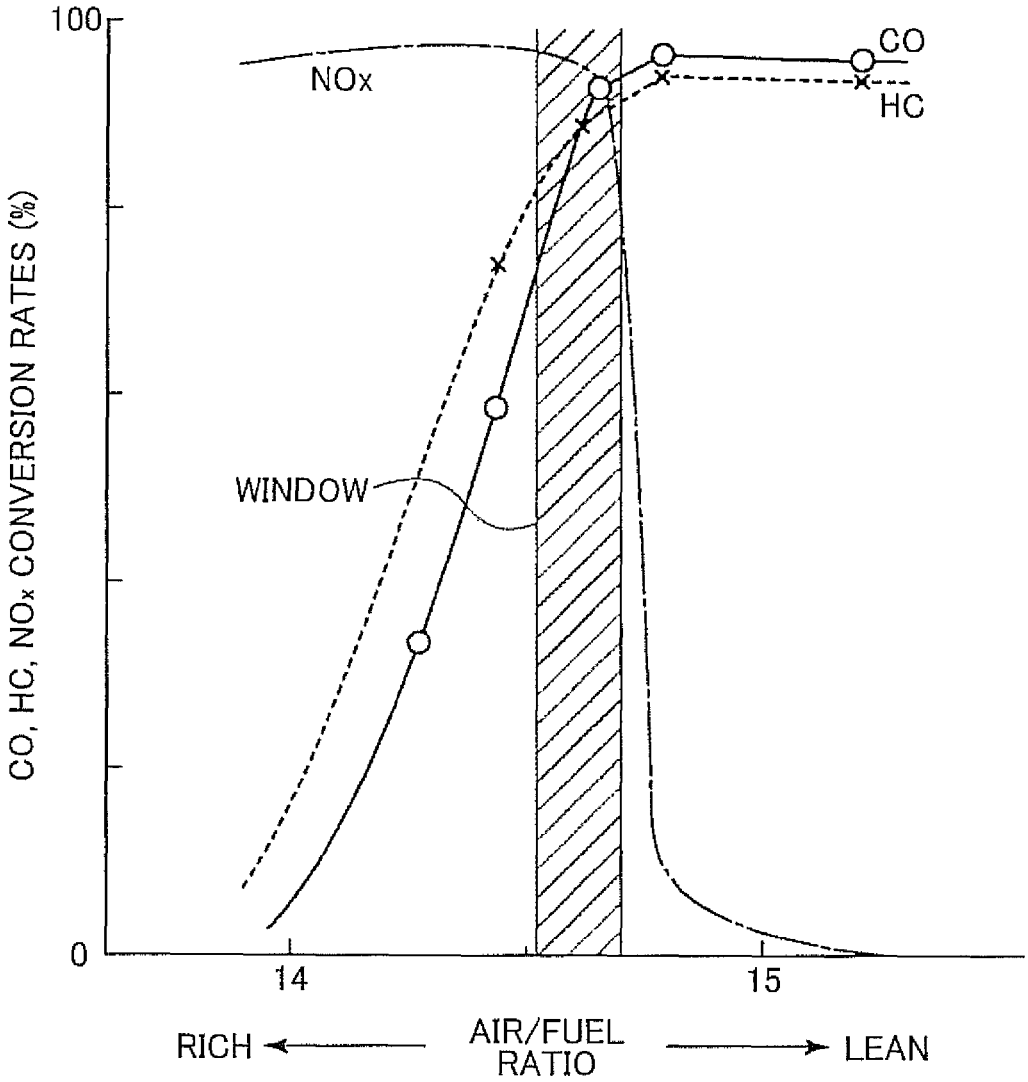
FIG. 3 is a graph showing an example of the purification characteristic of an exhaust gas purification catalyst in the internal combustion engine shown in FIG. 1.

The catalytic converter 40 includes a three-way catalyst, and therefore, as mentioned above, has a function of simultaneously purifying (removing, converting) NOx, HC and CO, which are pollutants in exhaust gas, when the air-fuel ratio A/F of the exhaust gas that flows into the catalytic converter 40 is in the vicinity of the stoichiometric ratio. However, the range (window) of the air-fuel ratio in which the three pollutants can be simultaneously removed with high efficiency (high-efficiency treatment region) is relatively narrow as shown in FIG. 3. FIG. 3 shows changes in the conversion rates of NOx, HC and CO. All of the conversion rates of the three pollutants are high in the vicinity of the stoichiometric ratio.

Therefore, during usual operation of the engine 10, the ECU 60 executes an air-fuel ratio control (e.g., a stoichiometric control) for controlling the air-fuel ratio of the exhaust gas that flows into the catalytic converter 40 to the vicinity of the stoichiometric ratio. The air-fuel ratio control includes a main air-fuel ratio control (main air-fuel ratio feedback control) for controlling through feedback the air-fuel ratio of a mixture (concretely, the amount of fuel injection) so that the exhaust air-fuel ratio detected by the pre-catalyst sensor 42 becomes equal to a predetermined target air-fuel ratio, and an auxiliary air-fuel ratio control (auxiliary air-fuel ratio feedback control) for controlling through feedback the air-fuel ratio of a mixture (concretely, the amount of fuel injection) so that the exhaust air-fuel ratio detected by the post-catalyst sensor 44 becomes equal to the predetermined target air-fuel ratio. Concretely, in the main air-fuel ratio feedback control, the ECU 60 executes a control to compute a first correction coefficient and to adjust the amount of fuel injection from the injectors 32 on the basis of the first correction coefficient so that the present exhaust air-fuel ratio detected on the basis of the output of the pre-catalyst sensor 42 becomes equal to the predetermined target air-fuel ratio. In the auxiliary air-fuel ratio feedback control, the ECU 60 executes a control to compute a second correction coefficient on the basis of the output of the post-catalyst sensor 44, and to accordingly correct the first correction coefficient obtained in the main air-fuel ratio feedback control.

Furthermore, in the engine 10, the exhaust system is configured so that the exhaust gas from the #1 cylinder contacts the pre-catalyst sensor 42 more strongly than the exhaust gas from each of the #2 to #4 cylinders, as mentioned above. That is, the #1 cylinder discharges the exhaust gas that has the strongest influence on the pre-catalyst sensor 42, among exhaust gases from the #1 to #4 cylinders. In view of this, in the engine 10, the amount of fuel injection for the #1 cylinder is reduced so that the exhaust air-fuel ratio regarding all the cylinders suitably approaches the vicinity of the stoichiometric air-fuel ratio. More concretely, in the engine 10, firstly, a basic amount of fuel injection based on the intake air flow rate and the engine revolution speed is subjected to various corrections (e.g., a correction based on the engine coolant temperature, and the aforementioned air-fuel ratio feedback correction) in order to compute an amount of fuel injection (hereinafter, referred to as "average amount of fuel injection"). Then, the amount of fuel injection for each cylinder is adjusted with respect to the average amount of fuel injection. With regard to the #1 cylinder and the #3 cylinder, an amount of fuel injection obtained by subtracting 2% of the average amount of fuel injection from the average amount of fuel injection is set as a (target) amount of fuel injection. On the other hand, with regard to the #2 cylinder and the #4 cylinder, an amount of fuel injection obtained by adding 2% of the average amount of fuel injection to the average amount of fuel injection is set as a (target) amount of fuel injection.

A reason why the amount of fuel injection is adjusted separately for each of the cylinders in the above-described manner will be further explained with reference to FIG. 3. As shown in FIG. 3, the air-fuel ratio window of the high-efficiency treatment region for the three-way catalyst is narrow and, on the lean side of this window, the NOx treatment capability sharply declines. On the other hand, on the rich side of the window, the HC and CO treatment capability declines gently. Therefore, when the exhaust air-fuel ratio regarding all the cylinders is controlled to the stoichiometric air-fuel ratio within the window in the foregoing air-fuel ratio feedback control, overall high-efficiency treatment of the three components is ensured by executing the air-fuel ratio control so that the exhaust air-fuel ratio is controlled toward the rich side in the window. That is, the exhaust gas from the #1 cylinder contacts the pre-catalyst sensor 42 most strongly (the exhaust gas from the #1 cylinder contacts the pre-catalyst sensor 42 more strongly than the exhaust gas from each of the #2 cylinder to the #4 cylinder), and therefore, when the air-fuel ratio of the exhaust gas from the #1 cylinder is controlled to be slightly on the lean side (i.e., to be slightly lean), there is a tendency that the exhaust air-fuel ratio is controlled to be slightly on the rich side (i.e., to be slightly rich) in the air-fuel ratio feedback control based on the output of the pre-catalyst sensor 42. As a result, the exhaust air-fuel ratio can be controlled to the stoichiometric air-fuel ratio or to the rich side within the window shown in FIG. 3. Therefore, it is possible to highly efficiently treat HC, CO and NOx in a balanced manner.

For example, there may be a situation where a failure of the injector 32 or the like is occurring in at least one of the cylinders (in particular, one cylinder) and therefore there is variation in the air-fuel ratio (imbalance) among the cylinders. For example, the fuel injection amount of the #1 cylinder becomes smaller than the fuel injection amount of each of the #2, #3 and #4 cylinders due to injection hole clogging or improper valve opening of the injector 32 of the #1 cylinder, and therefore the air-fuel ratio of the #1 cylinder deviates greatly to the lean side, that is, the air-fuel ratio of the #1 cylinder becomes greatly leaner than the air-fuel ratio of each of the #2, #3 and #4 cylinders.

Even in this case, the air-fuel ratio of exhaust supplied to the pre-catalyst sensor 42 can sometimes be controlled to the stoichiometric ratio if a relatively large correction amount is given by the aforementioned air-fuel ratio feedback control. However, in view of the individual cylinders, the air-fuel ratio of the #1 cylinder is greatly leaner than the stoichiometric ratio, and the air-fuel ratio of each of the #2, #3 and #4 cylinders is richer than the stoichiometric ratio, and the stoichiometric ratio is obtained merely as an overall balance. Thus, it is apparent that this state is not desirable in terms of exhaust emission. Particularly in this embodiment, this state is still more undesirable since the exhaust gas from the #1 cylinder contacts the pre-catalyst sensor 42 strongly. Therefore, in this embodiment, an apparatus that detects an inter-cylinder air-fuel ratio variation abnormality, that is, inter-cylinder air-fuel ratio imbalance and the abnormal lean deviation of the #1 cylinder (that is, an inter-cylinder air-fuel ratio imbalance detection apparatus) is provided.

The inter-cylinder air-fuel ratio imbalance detection apparatus detects the inter-cylinder air-fuel ratio variation abnormality (i.e., inter-cylinder air-fuel ratio imbalance) on the basis of fluctuation of the output of the engine 10, particularly, fluctuation of the revolution of the engine 10. The term "the fluctuation of revolution" signifies a change ΔNe of the engine revolution speed (or the crankshaft revolution speed) Ne. In this specification, a value that represents the fluctuation of revolution, that is, a value that represents the degree of fluctuation of revolution, is referred to as the amount of fluctuation of revolution. For example, the change ΔNe in the engine revolution speed itself may be used as the amount of fluctuation of revolution. Furthermore, an amount of time that is needed for the crankshaft to rotate by a predetermined angle may be measured, and a value (amount) obtained by subjecting the measured value to a computation process may be used as an amount of fluctuation of revolution. Through the description given below by using FIG. 4, it will be understood that various values can be used as the amount of fluctuation of revolution.

Figure 4:
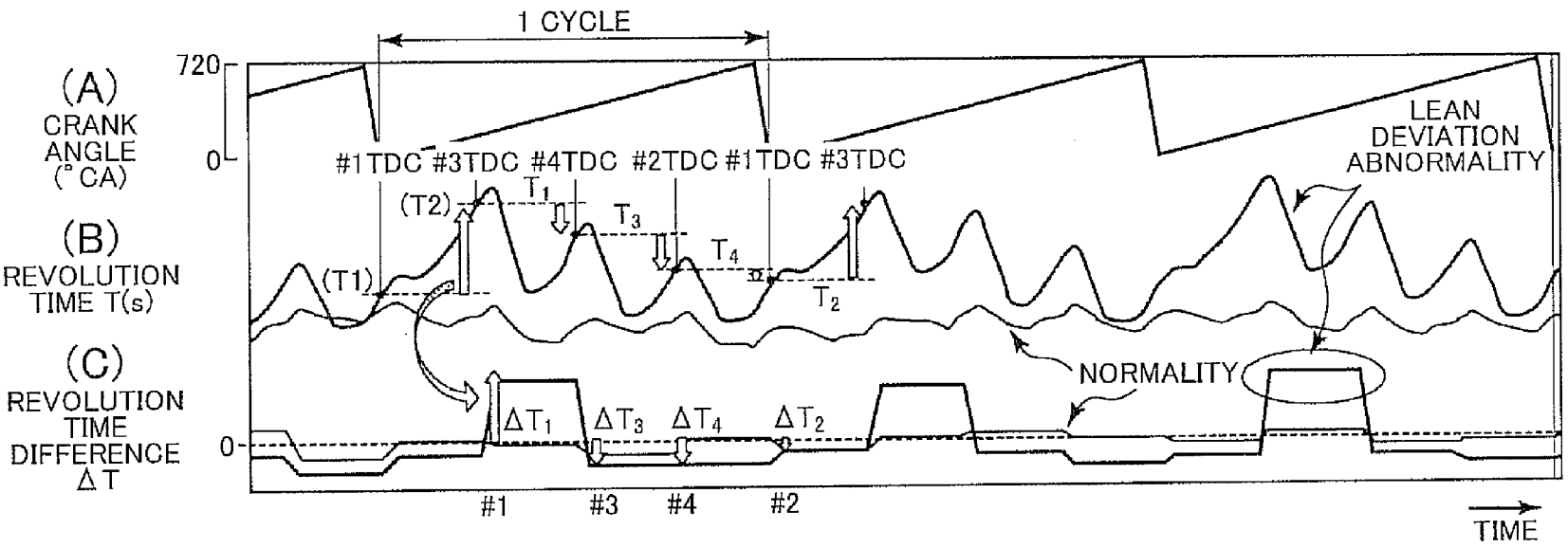
FIG. 4 is a time chart for describing an example of values that represent fluctuation of revolution.

FIG. 4 shows time charts as an example for describing the fluctuation of revolution. The example shown in FIG. 4 is an example of an in-line four-cylinder engine like the engine 10. However, it can be understood that the embodiment is also applicable to engines of other types and engines with different cylinder arrangements in similar manners. In the example shown in FIG. 4, the cylinder firing order is an order of the #1, #3, #4 and #2 cylinders.

In FIG. 4, a portion (A) shows the crank angle (° CA) of the engine. One engine cycle is 720 (° CA), and in the portion (A) of FIG. 4, successively detected crank angles over a plurality of cycles are shown in a saw-tooth form.

In FIG. 4, a portion (B) shows the time needed for the crankshaft to rotate by a predetermined angle, that is, the revolution time T(s). The predetermined angle herein is 30 (° CA), but may also be a different value (e.g., 10 (° CA)). As the revolution time T is longer (as the point indicating the revolution time T is located at a higher position in the figure), the engine revolution speed is lower. Conversely, as the revolution time T is shorter, the engine revolution speed is higher. The revolution time T is detected by the ECU 60 on the basis of the output of the crank angle sensor 62.

A portion (C) of FIG. 4 shows a revolution time difference ΔT described later. In FIG. 4, "NORMALITY" indicates a normal state where none of the cylinders has air-fuel ratio deviation, and "LEAN DEVIATION ABNORMALITY" shows an abnormal state where an abnormal lean deviation is occurring in only the #1 cylinder, that is, the amount of fuel injected into the #1 cylinder is evidently smaller than the amount of fuel injected into each of the other cylinders. The abnormal lean deviation occurs due to, for example, the clogging of the injection hole of an injector or improper valve opening of the injector.

Firstly, the revolution time T of each cylinder at the same timing is detected by the ECU. In this example, the revolution time T at the timing of the compression top dead center (TDC) of each cylinder is detected. The timing at which the revolution time T is detected is referred to as the detection timing.

At every detection timing, a difference (T2−T1) between the revolution time T2 at the present detection timing and the revolution time T1 at the immediately previous detection timing is calculated by the ECU. This difference is the revolution time difference ΔT shown in the portion (C) of FIG. 4, that is, ΔT=T2−T1.

Usually, during the combustion stroke after the crank angle exceeds the TDC, the revolution speed rises and therefore the revolution time T decreases, and during the subsequent compression stroke, the revolution speed decreases and therefore the revolution time T increases.

However, as shown in the portion (B) of FIG. 4, if an abnormal lean deviation is occurring in the #1 cylinder, ignition in the #1 cylinder does not bring about sufficient torque (output) and therefore the revolution speed does not easily rise, so that the revolution time T at the #3 cylinder's TDC is great. Hence, the revolution time difference ΔT at the #3 cylinder's TDC is a great positive value as shown in the portion (C) of FIG. 4. The revolution time and the revolution time difference at the #3 cylinder's TDC are defined as being the revolution time and the revolution time difference of the #1 cylinder, and are represented by $T_1$ and $\Delta T_1$, respectively. This similarly applies to the other cylinders as well.

Next, when ignition is performed in the #3 cylinder, the revolution speed sharply rises since the #3 cylinder is normal. This results in a slight decrease in the revolution time T at the time of the #4 cylinder's TDC in comparison with the revolution time T detected at the #3 cylinder's TDC. Therefore, the revolution time difference $\Delta T_3$ of the #3 cylinder detected at the #4 cylinder's TDC is a small negative value as shown in the portion (C) of FIG. 4. Thus, at every ignition cylinder's TDC, the revolution time difference ΔT of a cylinder is detected.

After that, a tendency similar to that observed at the #4 cylinder's TDC is observed at the #2 cylinder's TDC and the #1 cylinder's TDC, and the revolution time difference $\Delta T_4$ of the #4 cylinder and the revolution time difference $\Delta T_2$ of the

#2 cylinder detected at the two TDC timings are both small negative values. The above-described characteristic is repeated every engine cycle.

Thus, it should be understood that the revolution time difference ΔT of each cylinder is a value that represents fluctuation of revolution regarding each cylinder, and that correlates with the amount of deviation in the air-fuel ratio of each cylinder. Then, the revolution time difference ΔT of each cylinder can be used as an index value indicating the fluctuation of revolution thereof, that is, as an amount of revolution fluctuation thereof. As the air-fuel ratio deviation amount of each cylinder is greater, the fluctuation of revolution thereof is greater and the revolution time difference ΔT thereof is greater.

On the other hand, during the normal state, the revolution time difference ΔT of each cylinder is always in the vicinity of zero as shown in the portion (C) of FIG. 4.

Although the example shown in FIG. 4 illustrates the case of lean deviation abnormality, a similar tendency also occurs in the opposite case, that is, the case of rich deviation abnormality, that is, the case where only one cylinder has a large rich deviation. If a large rich deviation occurs, ignition brings about insufficient combustion due to the excessive fuel, so that sufficient torque cannot be obtained and the fluctuation of revolution becomes large.

For example, angular velocity ω, which is the reciprocal of the revolution time, can also be used as amount of fluctuation of revolution.

During the cold starting of the engine, the ignition timing retardation is performed as mentioned above. Therefore, if an abnormal lean deviation occurs in a cylinder during the cold engine start, that is, if the amount of fuel injection is small in a cylinder during the cold engine start, unstable combustion is likely to be caused. Thus, if an abnormal lean deviation occurs in a cylinder during the cold engine start, the power produced by that cylinder becomes less than the power produced by each of the other cylinders, so that the fluctuation of revolution or the amount of fluctuation of revolution becomes great, as described with reference to FIG. 4. Conversely, if an abnormal rich deviation occurs in a cylinder during the cold engine start, that is, if the amount of fuel injection is great in a cylinder during the cold engine start, the power produced by that cylinder tends to be larger than the power produced by each of the other cylinders unlike the case described above with reference to FIG. 4, so that the fluctuation of revolution regarding that cylinder becomes great, and a tendency opposite to that illustrated in FIG. 4 is exhibited. This is because during the cold starting of the engine, fuel evaporates less readily and, as mentioned above, the amount of air supplied into each cylinder is relatively large, so that an extra amount of fuel due to the excess supply can be burned. That is, in both of the case where an abnormal lean deviation occurs in a cylinder during the cold engine start and the case where an abnormal rich deviation occurs in the same cylinder during the cold engine start, the amount of fluctuation of the revolution regarding that cylinder is increased. However, the sign of the amount of fluctuation of the revolution in the case where an abnormal lean deviation occurs in a cylinder during the cold engine start differs from that in the case where an abnormal rich deviation occurs in the same cylinder during the cold engine start. Therefore, in this example, during the cold engine start, it is determined in which of the cylinders an abnormal lean deviation or an abnormal rich deviation is occurring, based on the amount of fluctuation of the revolution regarding each of the cylinders obtained in a predetermined period (e.g., one engine cycle or a plurality of engine cycles) (preferably, based on an average amount of fluctuation of revolution over a plurality of cycles). Concretely, when the amount of fluctuation of the revolution regarding a cylinder is greater than or equal to a predetermined amount, it can be determined that an abnormal deviation is occurring in the cylinder, and furthermore if the amount of fluctuation of the revolution regarding that cylinder has a predetermined sign, it can be determined that an abnormal lean deviation is occurring in the cylinder.

For example, the aforementioned method disclosed in Japanese Patent Application Publication No. 2010-112244 (JP 2010-112244 A) may be used to determine in which of the cylinders an abnormal lean deviation is occurring. In the invention, it is permitted to determine whether an abnormal lean deviation is occurring in a specific cylinder, by using any one of various known methods or any method that will be developed.

As mentioned above, when an inter-cylinder air-fuel ratio variation abnormality (an inter-cylinder air-fuel ratio imbalance) is detected, a driver or the like is notified of the abnormality (imbalance), for example, by turning on a warning lamp provided at the driver's seat. However, it is desirable to allow continued operation of the engine 10 while more effectively purifying exhaust gas by using the catalytic converter 40 even when such an abnormality (imbalance) is detected.

Figure 5:
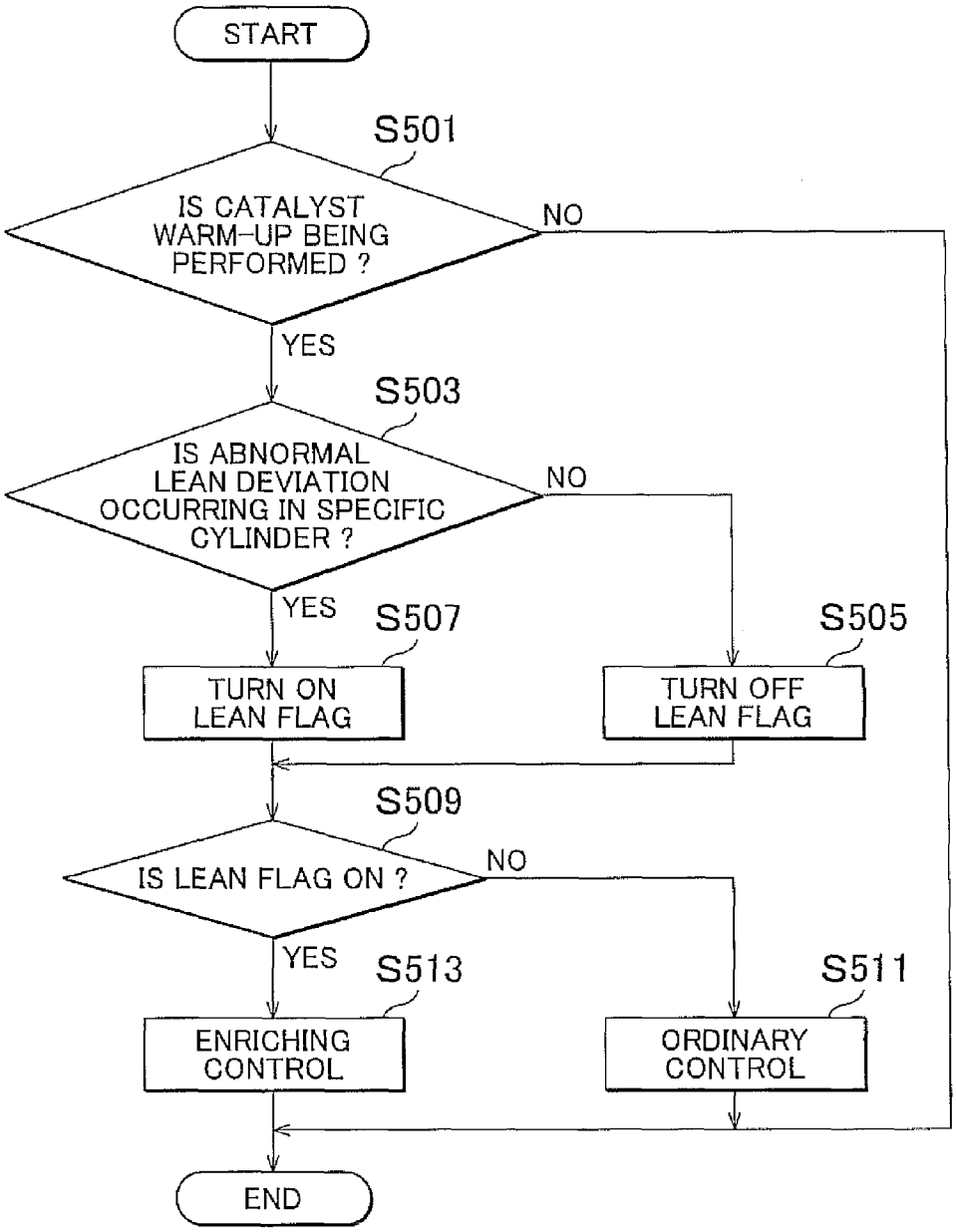
FIG. 5 is a flowchart in the first embodiment.

Therefore, in this example, as described in detail below, when it is detected that an abnormal lean deviation is occurring in the #1 cylinder that discharges the exhaust gas that influences the output of the pre-catalyst sensor 42 more strongly than the exhaust gas from any other cylinder, that is, an abnormal lean deviation is occurring in the specific cylinder, the fuel injection control or the air-fuel ratio control is executed so that an*enriching control is executed for the #1 cylinder. This control will be described with reference to a flowchart shown in FIG. 5.

The control described below is not applied when it is detected that an abnormal lean deviation is occurring in only any one or more of the #2 to #4 cylinders. The reason for this is as follows. That is, when it is detected that an abnormal lean deviation is occurring in the #2 or #4 cylinder, the influence of the abnormal lean deviation in either cylinder is reduced because the amount of fuel injection for the #2 and #4 cylinders has been made larger than the average amount of fuel injection as mentioned above. When an abnormal lean deviation is occurring in the #3 cylinder, an enriching correction has already been performed using the #1 cylinder by the aforementioned air-fuel feedback control, so that the influence of the abnormal lean deviation in the #3 cylinder is reduced. What is described above regarding the #3 cylinder can also be applied to the #2 and #4 cylinders.

When the engine 10 is started, the ECU 60 determines in step S501 whether the catalyst warm-up is being performed. Whether the catalyst warm-up is being performed is determined on the basis of the engine coolant temperature. For example, when the engine coolant temperature is lower than or equal to a predetermined temperature (e.g., 60° C.), an affirmative determination is made in step S501. The determination in step S501 is performed by the ECU 60 that substantially performs a function as a cold engine start operation determination portion. The determination in step S501 may be regarded as the determination as to whether cold engine start is being performed.

After an affirmative determination is made in step S501, it is then determined (detected) in step S503 whether an abnormal lean deviation is occurring in the specific cylinder, that is, the #1 cylinder. This determination is performed in the manner described above with reference to FIG. 4. This will be described again briefly. Firstly, the amount of fluctuation of the revolution of the engine 10 during the catalyst warm-up is determined by executing a predetermined computing process on the basis of the output of the crank angle sensor 62. Then, it is determined whether the sign of the amount of fluctuation of the revolution regarding the #1 cylinder is a predetermined sign, for example, plus, and whether the magnitude of the amount of fluctuation of the revolution is greater than or equal to a predetermined value (threshold value) $\alpha$. As a result, when the magnitude of the amount of fluctuation of the revolution regarding the #1 cylinder is greater than or equal to the predetermined value and the sign thereof is the predetermined sign, it is determined that an abnormal lean deviation is occurring in the #1 cylinder. The threshold value may be set as a value indicating that the deviation of the amount of fuel injection for the #1 cylinder to the lean side is deviation from the aforementioned average amount of fuel injection by an amount greater than or equal to a predetermined amount (e.g., 25% of the average amount of fuel injection). Performing this determination corresponds to detecting whether an abnormal lean deviation is occurring in the #1 cylinder. This determination is performed by the ECU 60 that performs a function as the abnormal lean deviation detection portion.

If a negative determination is made in step S503, a lean flag is turned off in step S505. On the other hand, if in step S503 it is determined that an abnormal lean deviation is occurring in the specific cylinder, the lean flag is turned on in step S507. The lean flag is off in an initial state.

Following step S505 or S507, it is determined in step S509 whether the lean flag is on. If the lean flag is off, a negative determination is made in step S509, and then an ordinary control mode is set in step S511. Therefore, as described above, the fuel injection control is executed so that with regard to the #1 and #3 cylinders, the amount of fuel injection is reduced from the average amount of fuel injection by 2% of the average amount, and with regard to the #2 and #4 cylinders, the amount of fuel injection is increased from the average amount of fuel injection by 2%.

On the other hand, if the lean flag is on, an affirmative determination is made in step S509, and an enriching control mode is set in step S513. Therefore, with regard to the #1 cylinder, the ECU executes a fuel injection amount control (enriching control) in which the amount of fuel injection is made greater than the amount of fuel injection set during the ordinary control mode. In this example, when the enriching control mode has been set, the amount of fuel injected into the #1 and #3 cylinders is increased from the average amount of fuel injection by 2% of the average amount, and the amount of fuel injected into the #2 and #4 cylinders is decreased from the average amount of fuel injection by 2% of the average amount of fuel injection. Thus, the enriching control for the #1 cylinder includes execution of an averaging control of adjusting the amounts of fuel injection for all the other #2 to #4 cylinders so that the enriching control does not change the total amount of fuel injection for all the cylinders. This is executed for the purpose of more suitably making the exhaust air-fuel ratio closer to a stoichiometric ratio when the amount of fuel injected into the #1 cylinder is increased.

In this manner, in the first embodiment, at the time of the starting of the engine and particularly at the time of cold start of the engine, detection (determination) as to whether an abnormal lean deviation is occurring in the specific cylinder is performed, and on the basis of a result of the detection (determination), one of the ordinary control mode and the enriching control mode is set and maintained until the engine stops. When the engine stops (the ignition switch is turned off), the control mode is reset. The ordinary control mode is set in an initial state (the ordinary control mode is set as an initial mode).

As described above, according to the first embodiment, when an abnormal lean deviation is occurring in the #1 cylinder, that is, the specific cylinder, the enriching control of increasing the amount of fuel injected into the #1 cylinder is executed. Thus, it is possible to prevent a situation where a conspicuous lean state is detected by the pre-catalyst sensor 42 due to the exhaust gas from the #1 cylinder, and therefore it is possible to prevent a situation where an excessive rich correction is performed due to the detected conspicuous lean state. Therefore, it is possible to prevent a situation where the amount of fuel injection for the other cylinders is excessively increased so that the air-fuel ratio of exhaust gas in each of the other cylinders departs greatly to the rich side from the window shown in FIG. 3. Furthermore, due to the enriching control, the amount of fuel injection for the #1 cylinder is increased, so that the possibility of occurrence of misfire in the #1 cylinder is reduced. Therefore, it is possible to prevent a situation where it becomes difficult to purify (remove, convert), for example, the hydrocarbon component by the catalytic converter 40. Hence, it is possible to continue operating the engine 10 more suitably.

In the enriching control for the #1 cylinder, the target amount of fuel injection for the #1 cylinder may be set to the average amount of fuel injection, or may be increased from the amount of fuel injected into the #1 cylinder at a time when an abnormal lean deviation is not occurring in the #1 cylinder (an abnormal lean deviation of the #1 cylinder is not detected), by an appropriate percentage, for example, 1%, of the average amount of fuel injection. The amount of increase in the amount of fuel injection for the #1 cylinder may be variably set on the basis of the degree of abnormal lean deviation of the #1 cylinder. For example, the amount of fuel injection for the #1 cylinder may be increased by 2% of the average amount of fuel injection if the degree of abnormal lean deviation of the #1 cylinder corresponds to 25% of the average amount of fuel injection, and may be increased by 4% of the average amount of fuel injection if the degree of abnormal lean deviation of the #1 cylinder corresponds to 30% of the average amount of fuel injection. As the value that indicates the degree of abnormal lean deviation, it is possible to use the amount of fluctuation of revolution used in step S503 or a value that corresponds to the amount of fluctuation of revolution. Then, in association with such an increase of the amount of fuel injection for the #1 cylinder, the amount of fuel injection for each of the other cylinders may be appropriately adjusted in the averaging control.

Next, a second embodiment of the invention will be described. A configuration of an engine to which the second embodiment is applied is substantially the same as the configuration of the engine 10 to which the first embodiment is applied. Therefore, in the following description, components that correspond to those described above are denoted by the same reference characters, and the components of the engine to which the second embodiment is applied will not be redundantly described.

In the second embodiment, unlike the first embodiment, once it is detected that an abnormal lean deviation is occurring in the specific cylinder, that is, the #1 cylinder, and therefore the lean flag is turned on, the on-state of the flag is maintained even after the engine is stopped. Therefore, once the enriching control mode is set, the fuel injection control is executed in the enriching control mode when the engine is restarted after the engine is stopped. In the second embodiment, however, after the enriching control mode is set, it is determined during operation of the engine whether an inter-cylinder air-fuel ratio variation abnormality, that is, inter-cylinder air-fuel ratio imbalance is occurring in the engine 10. On the basis of a result of the determination, the enriching control is ended. As can be understood from the foregoing description, the ECU 60 further performs functions as an imbalance absence detection portion that detects (determines) whether inter-cylinder air-fuel ratio imbalance is absent (there is no inter-cylinder air-fuel ratio imbalance, no inter-cylinder air-fuel ratio is occurring) after it is detected by the abnormal lean deviation detection portion that an abnormal lean deviation is occurring in the specific cylinder, and an ending portion that ends the operation of the enriching control portion when it is detected by the imbalance absence detection portion that inter-cylinder air-fuel ratio imbalance is absent (there is no inter-cylinder air-fuel ratio imbalance, no inter-cylinder air-fuel ratio is occurring).

Figure 6:
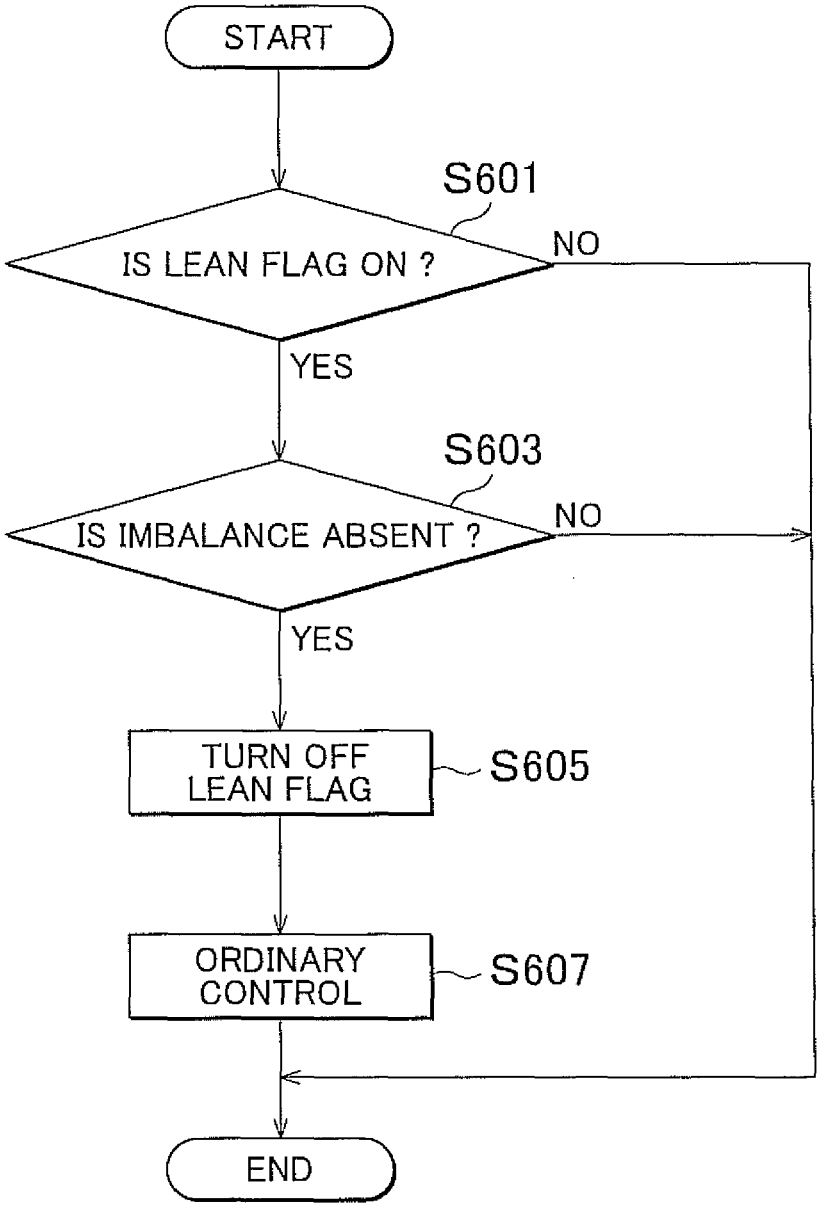
FIG. 6 is a flowchart in a second embodiment.

In the second embodiment, too, at the time of start of the engine and particularly at the time of cold start of the engine, it is determined whether an abnormal lean deviation is occurring in the #1 cylinder, that is, the specific cylinder, as described above with reference to FIG. 5, and the ordinary control mode or the enriching control mode is set on the basis of a result of the determination, that is, a result of the detection. Furthermore, after the warm-up, the control is executed according to a flowchart shown in FIG. 6. The routine shown in FIG. 6 is repeatedly executed.

In step S601, it is determined whether the lean flag is on. If the lean flag has already been turned on, an affirmative determination is made. If not, a negative determination is made, and the routine ends.

If an affirmative determination is made in step S601, it is then determined in step S603 whether inter-cylinder air-fuel ratio imbalance is absent. This step corresponds to detecting (determining) whether inter-cylinder air-fuel ratio imbalance is absent after it is detected that an abnormal lean deviation is occurring in the #1 cylinder, which is the specific cylinder. This step is performed by the ECU 60 that performs a function as the imbalance absence detection portion. It is determined that inter-cylinder air-fuel ratio imbalance is absent, that is, there is no inter-cylinder air-fuel ratio variation abnormality, if at least one of first and second conditions shown below is satisfied.

The first condition is that no inter-cylinder air-fuel ratio imbalance is detected on the basis of change in the air-fuel ratio based on the output of the pre-catalyst sensor 42. The second condition is that no inter-cylinder air-fuel ratio imbalance is detected on the basis of the amount of fluctuation of the revolution of the engine 10 obtained as described above. The first condition and the second condition will be further described. The phrase "no inter-cylinder air-fuel ratio imbalance is detected" may signify that, for example, inter-cylinder air-fuel ratio imbalance beyond a predetermined level is not occurring.

Figure 7:
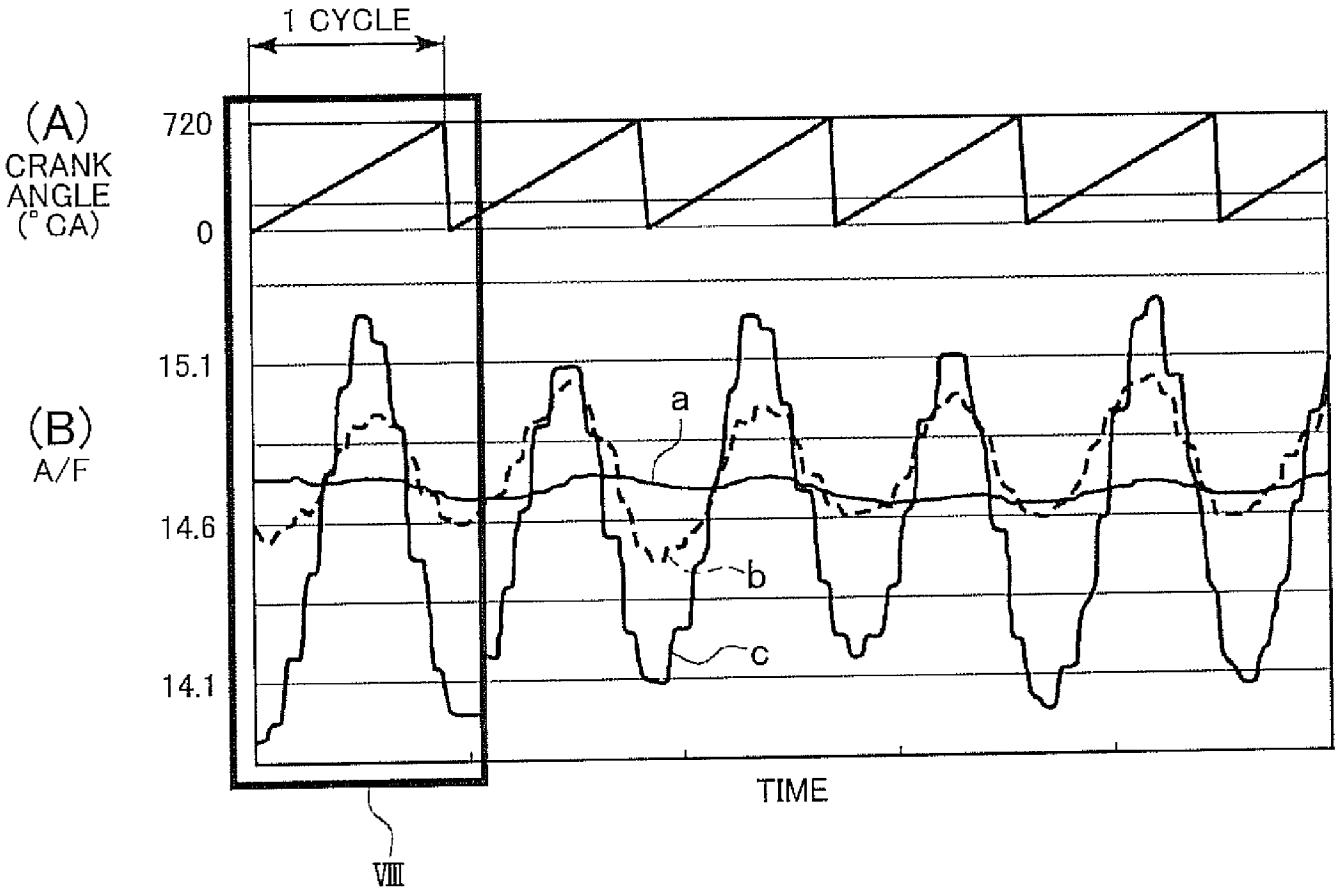
FIG. 7 is a graph showing fluctuation of the exhaust air-fuel ratio according to the degree of inter-cylinder air-fuel ratio imbalance.

Firstly, the first condition will be described with reference to FIG. 7 and FIG. 8. FIG. 7 is a graph showing fluctuation of the exhaust air-fuel ratio according to the degree of inter-cylinder air-fuel ratio imbalance. As shown in FIG. 7, if inter-cylinder air-fuel ratio imbalance occurs, fluctuation of the exhaust air-fuel ratio during one engine cycle (=720° C.) becomes large. Air-fuel ratio lines a, b and c in a portion (B) of FIG. 7 respectively show the air-fuel ratios A/F detected by the pre-catalyst sensor 42 in the case where there is no inter-cylinder air-fuel ratio imbalance, the case where there is a rich deviation, that is, the amount of fuel injection for only one cylinder is larger than the amount of fuel injection for each of the other three cylinders, and the case where a greater rich deviation is present in only one cylinder. As shown in FIG. 7, as the degree of imbalance is greater, the amplitude of the fluctuation in the air-fuel ratio is greater. What is described above can be applied to the case of lean deviation in which the amount of fuel injection for only one cylinder is smaller than the amount of fuel injection for each of the other cylinders. As can be understood from FIG. 7, as the degree of inter-cylinder air-fuel ratio imbalance is greater, the fluctuation of the output of the pre-catalyst sensor 42 is greater. Therefore, by utilizing the above-described characteristic, the inter-cylinder air-fuel ratio imbalance can be detected by using an output fluctuation parameter that represents the degree of fluctuation of the output of the pre-catalyst sensor 42 as a parameter that represents the degree of inter-cylinder air-fuel ratio imbalance.

Hereinafter, a method for detecting the output fluctuation parameter will be described below. FIG. 8 is an enlarged view corresponding to a portion VIII shown in FIG. 7, and particularly shows fluctuation of the output of the pre-catalyst sensor in one engine cycle. As the output of the pre-catalyst sensor, a value obtained by converting the output voltage Vf of the pre-catalyst sensor 42 into the air-fuel ratio A/F is used. However, the output voltage Vf of the pre-catalyst sensor 42 can also be directly used.

Figure 8:
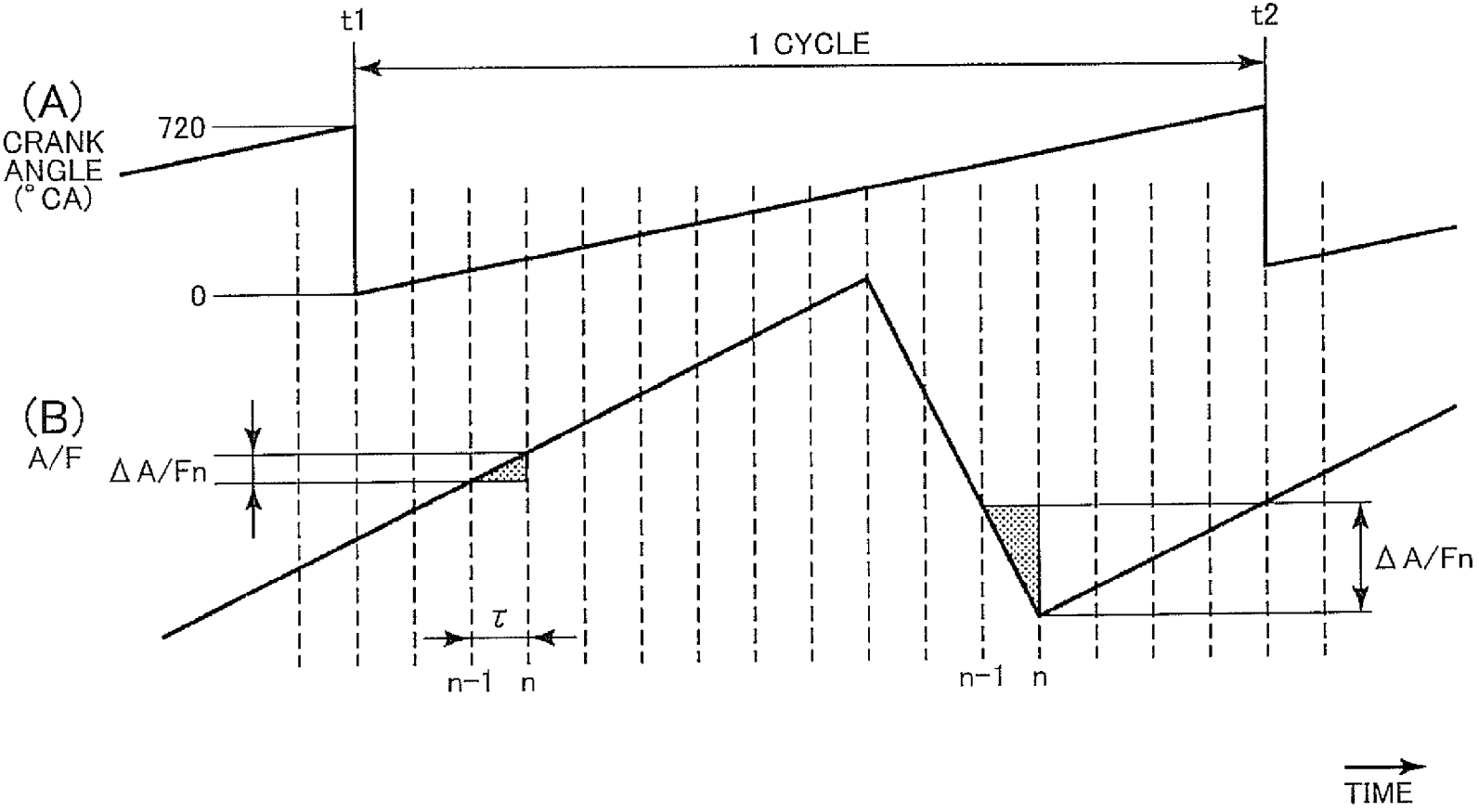
FIG. 8 is an enlarged schematic diagram corresponding to a portion VIII shown in FIG. 7.

As shown in the portion (B) of FIG. 8, the ECU 60 acquires a value of the pre-catalyst sensor output A/F at every predetermined sample period $\tau$ (unit time, e.g., 4 ms) in one engine cycle. Then, a difference $\Delta A/F_n$ ($=A/F_n-A/F_{n-1}$) between the value $A/F_n$ acquired at the present timing (second timing) and the value $A/F_{n-1}$ acquired at the previous timing (first timing) is determined. The difference $\Delta A/F_n$ may also be referred to as a derivative value or a slope at the present timing.

Most simply put, the difference $\Delta A/F_n$ represents the fluctuation of the output of the pre-catalyst sensor. This is because as the degree of fluctuation is greater, the slope of the air-fuel ratio line is greater and the absolute value of the difference $\Delta A/F_n$ is greater. Therefore, the absolute value of the difference $\Delta A/F_n$ at a predetermined timing can be set as an output fluctuation parameter.

However, in this example, for the sake of accuracy improvement, an average value of a plurality of the absolute values of differences $\Delta A/F_n$ is set as an output fluctuation parameter. In the embodiment, the absolute values of differences $\Delta A/F_n$ are accumulated at a plurality of timings in one engine cycle, and then the final accumulated value is divided by the number N of the samples to obtain an average value of the absolute values of the differences $\Delta A/F_n$ within one engine cycle. Furthermore, the average values of the absolute values of differences $\Delta A/F_n$ are accumulated over M number of engine cycles (e.g., M=100), and the final accumulated value is divided by the number M of engine cycles to obtain an average value of the absolute values of differences $\Delta A/F_n$ in the M number of engine cycles. The final average value obtained in this manner is set as an output fluctuation parameter. Then, when the final average value is less than or equal to a predetermined value, it is determined that inter-cylinder air-fuel ratio imbalance is absent in the engine 10 (there is no inter-cylinder air-fuel ratio imbalance in the engine 10), that is, there is no inter-cylinder air-fuel ratio variation abnormality in the engine 10.

The second condition will be described. As already described above with reference to FIG. 4, it is possible to determine whether there is inter-cylinder air-fuel ratio imbalance on the basis of the amount of fluctuation of the revolution of the engine. In this example, the amount of fluctuation of revolution is determined on the basis of the output produced by the crank angle sensor 62 in one cycle or a plurality of cycles of the engine 10 while the vehicle provided with the engine 10 is traveling. When the amount of fluctuation of the revolution of the engine 10 or the average value thereof is less than or equal to a predetermined value, it is determined that there is no imbalance.

However, the second condition may include a condition that it is determined that imbalance is absent (there is no imbalance) on the basis of the amount of fluctuation of the revolution during stoppage of the vehicle (i.e., at the time when the vehicle is in a stopped state). In this case, when the amount of fluctuation of the revolution while the vehicle V is traveling is less than or equal to a first predetermined value, it is determined whether the amount of fluctuation of the revolution during stoppage of the vehicle V is less than or equal to a second predetermined value. The amount of fluctuation of the revolution during stoppage of the vehicle V is determined in the same manner as the manner in which the amount of fluctuation of the revolution while the vehicle V is traveling is determined. In this case, the first predetermined value and the second predetermined value may be equal or different. Preferably, the first predetermined value is larger than the second predetermined value. This is because when the vehicle is traveling, the determined amount of fluctuation of revolution is influenced by the road surface. Then, when the amount of fluctuation of revolution during stoppage of the vehicle is less than or equal to the second predetermined value, it is determined that there is no inter-cylinder air-fuel ratio imbalance (inter-cylinder air-fuel ratio imbalance is absent).

As described above, if in step S603 it is determined that there is no inter-cylinder air-fuel ratio imbalance, that is, it is determined that the imbalance is absent, an affirmative determination is made in step S603. If a negative determination is made in step S603, the routine ends.

If an affirmative determination is made in step S603, the lean flag is turned off in step S605. Subsequently, in step S607, the ordinary control mode is set in place of the enriching control mode, and then the routine ends. Thus, the engine 10 is operated as mentioned above.

As described above, in the second embodiment, at the time of start-up of the engine, particularly, at the time of cold start of the engine, the enriching control mode is set if an abnormal lean deviation is occurring in the specific cylinder, and the ordinary control mode is set if no abnormal lean deviation is occurring in the specific cylinder. Furthermore, if inter-cylinder air-fuel ratio imbalance is not detected (it is determined that inter-cylinder air-fuel ratio imbalance is absent) in the engine while the vehicle is traveling or the vehicle is in the stopped state although the enriching control mode has been set, the ordinary control mode is set. Therefore, if the imbalance is not detected after the enriching control mode is set, for example, if the abnormality regarding the fuel injection in the #1 cylinder is eliminated, the ordinary control mode is set. Therefore, it is possible to continue operating the engine 10 more suitably. The return to the ordinary control mode in this manner is also effective in the case where the enriching control mode is set on the basis of a false detection that an abnormal lean deviation is occurring in the specific cylinder.

While the invention has been described with reference to the first and second embodiments, various modifications may be made to the invention. For example, when the ordinary control mode has been set, the amount of fuel injection for the #1 cylinder and the #3 cylinder is different from the amount of fuel injection for the #2 cylinder and the #4 cylinder in the foregoing two embodiments. However, for example, the amounts of fuel injection for all the cylinders may be equal. In this case, the average amount of fuel injection is set as a target amount of fuel injection for all the cylinders. Furthermore, when the ordinary control mode or the enriching control mode has been set, the amounts of fuel injection for all the cylinders may be set in a manner other than the manner mentioned in the foregoing embodiments. For example, in the foregoing embodiments, when the ordinary control mode has been set, the fuel injection control is executed so that with regard to the #1 cylinder and the #3 cylinder, the target amount of fuel injection is set to an amount obtained by subtracting a predetermined percentage of the average amount of fuel injection from the average amount of fuel injection, and with regard to the #2 cylinder and the #4 cylinder, the target amount of fuel injection is set to an amount obtained by adding a predetermined percentage of the average amount of fuel injection to the average amount of fuel injection. In this case, for example, when the enriching control mode is set, the average amount of fuel injection may be set as the target amount of fuel injection for all the cylinders. Furthermore, in the foregoing embodiments, among the four cylinders, the #1 cylinder, which discharges the exhaust gas that influences the output of the pre-catalyst sensor 42 most strongly, is the specific cylinder (the #1 cylinder, which discharges the exhaust gas that influences the output of the pre-catalyst sensor 42 more strongly than the exhaust gas from each of the other cylinders, is the specific cylinder). However, among a plurality of cylinders, two or more cylinders that discharge exhaust gas that influences the output of an air-fuel ratio sensor more strongly than exhaust gas from each of the rest of the plurality of cylinders may be regarded as the specific cylinder.

While the invention has been described above with reference to the embodiments, modifications, etc., the invention may be implemented in other embodiments. Furthermore, the invention is applicable to various types of multi-cylinder engines that have two or more cylinders, including port injection engines and, further, in-cylinder injection engines, engines that use a gas as a fuel, etc. Furthermore, the invention is also applicable to engines in so-called hybrid vehicles or hybrid electric vehicles that are provided with an internal combustion engine and an electric motor as drive power sources.

Furthermore, in the foregoing embodiments, the amount of fluctuation of revolution is used to perform determination regarding the output fluctuation or evaluate the output fluctuation. However, other values or quantities can also be used as the amount of output fluctuation.

The embodiments of the invention are not limited to the foregoing embodiments, but the invention includes all modifications, applications and equivalents encompassed within the idea of the invention prescribed by the claims for patents. Therefore, the invention should not be interpreted in a limited manner, but can also be applied to any other technologies that belong to the range of the idea of the invention.

What is claimed is:

1. A control apparatus for an internal combustion engine, the control apparatus being configured to execute an air-fuel ratio control based on an output of an air-fuel ratio detector provided in an exhaust passage through which exhaust gas from a plurality of cylinders flows, the control apparatus comprising:

an abnormal lean deviation detection portion configured to detect whether an abnormal lean deviation is occurring in at least one specific cylinder among the plurality of cylinders, the exhaust gas from the at least one specific cylinder influencing the air-fuel ratio detector more strongly than the exhaust gas from each of a rest of the plurality of cylinders; and an enriching control portion configured to execute an enriching control for the at least one specific cylinder when the abnormal lean deviation detection portion detects that the abnormal lean deviation is occurring in the at least one specific cylinder;

wherein the abnormal lean deviation detection portion detects whether the abnormal lean deviation is occurring in the at least one specific cylinder based on a change in engine revolution speed at a time of cold engine start or a value that represent the change in the engine revolution speed at the time of cold engine start.

2. The control apparatus according to claim 1, wherein the enriching control portion executes the enriching control for the at least one specific cylinder so that an amount of fuel injection for the at least one specific cylinder is larger than that at a time when the abnormal lean deviation detection portion detects that no abnormal lean deviation is occurring in the at least one specific cylinder.

3. The control apparatus according to claim 2, wherein the enriching control portion executes the enriching control for the at least one specific cylinder so that the amount of fuel injection for the at least one specific cylinder is larger than that at the time when the abnormal lean deviation detection portion detects that no abnormal lean deviation is occurring in the at least one specific cylinder, by an amount based on a degree of the abnormal lean deviation detected by the abnormal lean deviation detection portion.

4. The control apparatus according to claim 1, wherein when the enriching control portion executes the enriching control for the at least one specific cylinder, the enriching control portion executes an averaging control for the plurality of cylinders excluding the at least one specific cylinder so that a total amount of fuel injection for all the plurality of cylinders is not changed by the enriching control.

5. The control apparatus according to claim 1, wherein the at least one specific cylinder is one cylinder, the exhaust gas from the one cylinder influencing the air-fuel ratio detector more strongly than the exhaust gas from each of the rest of the plurality of cylinders.

6. The control apparatus according to claim 1, further comprising:

an imbalance absence detection portion configured to detect whether inter-cylinder air-fuel ratio imbalance is absent after the abnormal lean deviation detection portion detects that the abnormal lean deviation is occurring in the at least one specific cylinder; and an ending portion configured to end an operation of the enriching control portion when the imbalance absence detection portion detects that the inter-cylinder air-fuel ratio imbalance is absent.

* * * * *